US007063578B2

(12) United States Patent
Goto

(10) Patent No.: US 7,063,578 B2
(45) Date of Patent: Jun. 20, 2006

(54) ELECTRICAL CONNECTOR HAVING IMPROVED TERMINAL POSITIONING ASSURANCE MEMBER

(75) Inventor: Kazuhiro Goto, Markham (CA)

(73) Assignee: Tyco Electronics Canada, Ltd., Markham (CA)

( * ) Notice: Subject to any disclaimer, the term of this patent is extended or adjusted under 35 U.S.C. 154(b) by 0 days.

(21) Appl. No.: 10/943,515

(22) Filed: Sep. 17, 2004

(65) Prior Publication Data

US 2006/0063414 A1 Mar. 23, 2006

(51) Int. Cl.
*H01R 13/514* (2006.01)

(52) U.S. Cl. ..... 439/752; 439/595

(58) Field of Classification Search ..... 439/595, 439/752

See application file for complete search history.

(56) References Cited

U.S. PATENT DOCUMENTS 5,575,683 A * 11/1996 Saito et al. ..... 439/595
5,618,207 A 4/1997 Maejima
5,709,831 A 1/1998 Endo et al.
5,746,624 A * 5/1998 Ohsumi et al. ..... 439/595
6,053,753 A 4/2000 Kunkle
6,062,906 A * 5/2000 Tanaka ..... 439/595
6,354,867 B1 * 3/2002 Tachi et al. ..... 439/488
6,478,620 B1 * 11/2002 Bonavita et al. ..... 439/595
6,599,150 B1 7/2003 Martin et al.
6,645,015 B1 * 11/2003 Mase et al. ..... 439/752
6,926,556 B1 * 8/2005 Tsuji ..... 439/595
2002/0076992 A1 * 6/2002 Kurimoto et al. ..... 439/752

* cited by examiner

*Primary Examiner*—Tho D. Ta

(57) ABSTRACT

An electrical connector is shown having a connector housing and a terminal positioning assurance member. The housing has slots which co-exist in a parallel manner with terminal receiving passageways of the housing. The terminal positioning assurance member has leg portions receivable transversely of the slots, and the TPA is movable from a position where a primary latch in the connector can be biased into the slot to allow the insertion of a terminal into the cavity of the housing and the terminal positioning assurance member can be moved to a locked position, where legs of the TPA, which are movable within the slot, are moved behind the latch, preventing the movement of the latch members.

27 Claims, 9 Drawing Sheets

ELECTRICAL CONNECTOR HAVING IMPROVED TERMINAL POSITIONING ASSURANCE MEMBER

FIELD OF THE INVENTION

The invention is directed to electrical connectors and more particularly to electrical connectors having a terminal positioning assurance member.

BACKGROUND OF THE INVENTION

In various applications of electrical connectors, devices are utilized to lock the terminals in place and to assure that they are in proper position within the electrical connector. One such field is in the automotive field where the application typically requires a so-called secondary locking system, that is, a redundant retention system for locking the terminals in place, as well as a terminal position assurance mechanism (TPA) which assures that the terminals are proper position longitudinally within the respective cavities. This prevents a proper mating of a corresponding electrical connector, where some of the lines are open due to one or more terminals not being fully loaded.

Certain electrical connectors are provided with housings having cavities extending therethrough for receiving terminals, each cavity provided with a resilient locking latch integrally molded with the housing for locking a terminal inserted therein. In order to further secure the terminals within the housing, it is common to provide a secondary housing member that is moveable against the locking latches to prevent the locking latches from outwardly biasing. In other words, the locking latches are blocked into their latching position. It is known to provide the secondary member pre-assembled to the housing in a pre-assembly position that allows insertion of the terminals into the connector cavities. The secondary member can then be moved to a fully locked position whereby the terminals are locked in the cavities. This type system is shown for example in U.S. Pat. Nos. 6,053,753 and 6,599,150.

In essence, these TPAs constitute front-loaded wedges that are shipped in a pre-stage position, which are intended to be activated, or moved into their final position, after the terminals are assembled into the housing. Traditionally, these connectors are shipped in bulk to the end user or harness maker, where the wire harnesses are made, wires crimped to the terminals, and terminals inserted into the housing cavities. Thereafter, the TPA member is moved into the final position. However, one of the difficulties with such system is that these systems tend to become locked during shipping, and the customer is left with the task of attempting to dislodge the TPA from the final locked position.

Another connector system is shown in U.S. Pat. No. 5,618,207, where a spacer is inserted through a rear of the connector, and has spacer pieces which align with a locking latch of a housing. This system however, does not prevent the connection to a mating connector, in the event the spacer is not in the fully locked position.

The objects of the invention are to improve upon the above-mentioned systems.

The objects have been accomplished by providing an electrical connector, comprising a housing having at least one terminal receiving cavity extending between a mating face and a terminal receiving face. A resilient latch extends from an internal sidewall of the at least one terminal receiving cavity, the latch being spaced from the internal sidewall to form a spacing for the resilient movement of the latch towards the internal sidewall. A slot extends through the housing and into the cavity, the slot being generally aligned with the spacing. An access opening extends through the housing and into communication with the slot. A terminal positioning assurance member (TPA), is comprised of at least a leg portion which is movable through the access opening into the slot, the TPA being slidable between a position allowing flexure of the latch and a position into the spacing, preventing substantial flexing of the latch.

The TPA may further comprise a foot portion extending from the leg portion, the foot portion being profiled to extend under, and lock the TPA to the latch member. The foot portion and the free end of the latch may have complementary compound surfaces, profiled such that movement of the leg portion into the slot causes the latch to flex away from the inner sidewall, until the foot portion resides beneath the latch. The foot portion may extend rearwardly further that the leg portion, whereby, when the leg portion is moved to a forward position outside of the slot, the foot portion is still locked beneath the latch.

The electrical connector housing can also be provided with at least two terminal receiving cavities, and two slots, and the TPA has two leg portions movable into the slots, with a bridge portion spanning the foot portions. The bridge portion may be profiled to lie adjacent to an outer wall of the housing, and slide along the surface thereof in the sliding movement of the TPA. The bridge portion and outer wall may include cooperating latching members to latch the TPA in the locked position. The bridge portion and outer wall may also include cooperating latching members to maintain the bridge in a position adjacent the housing outer wall.

In another embodiment of the invention, an electrical connector comprises a housing having at least one terminal receiving cavity extending between a mating face and a terminal receiving face. A resilient latch extends from an internal sidewall of the at least one terminal receiving cavity, the latch being spaced from the internal sidewall to form a spacing for the resilient movement of the latch towards the internal sidewall. A slot extends through the housing and into the cavity, the slot being generally aligned with the spacing. A terminal positioning assurance member (TPA), comprised of at least a leg portion is movable into the slot and into the spacing, the TPA further comprising a foot portion extending from the leg portion, the foot portion being profiled to extend under, and lock the TPA to the latch member.

The TPA may be slidable between positions in the spacing preventing substantial flexing of the latch, and forward of the spacing, to a position allowing flexure of the latch, the foot member being slidable along the length of the latch. The foot portion and the free end of the latch may have complementary compound surfaces, profiled such that movement of the leg portion into the slot causes the latch to flex away from the inner sidewall, until the foot portion resides beneath the latch. The foot portion may extend rearwardly further than the leg portion, whereby, when the leg portion is moved to a forward position outside of the slot, the foot portion is still locked beneath the latch.

The housing may have at least two terminal receiving cavities and two slots, and the TPA may have two leg portions movable into the slots, with a bridge portion spanning the foot portions. The bridge portion may be profiled to lie adjacent to an outer wall of the housing, and slide along the surface thereof in the sliding movement of the TPA. The bridge portion and outer wall may include cooperating latching members to latch the TPA in the locked position. The bridge portion and outer wall may include cooperating latching members to maintain the bridge in a position adjacent the housing outer wall.

In yet another embodiment of the invention, an electrical connector comprises a housing having at least one terminal receiving cavity extending between a mating face and a terminal receiving face, a resilient latch extends from an internal sidewall of the at least one terminal receiving cavity, the latch being spaced from the internal sidewall to form a spacing for the resilient movement of the latch towards the internal sidewall. A terminal positioning assurance member (TPA) is comprised of a first portion which prevents the latch from biasing inwardly, and a second portion which retains the TPA to the resilient latch.

The TPA first portion may be comprised of a leg portion, which is slidably movable within the spacing. The TPA second portion may be comprised of a foot portion extending from the leg portion, the foot portion being profiled to extend under, and lock the TPA to the latch member. The electrical connector may also further comprise a slot extending through the housing and into the cavity, with the slot being generally aligned with the spacing, and with the leg portion being movable into the slot and into the locked position with the latch.

The slot may extend into the housing transversely of the spacing, and the leg portion being slidably movable along the slot while retained to the latch. The foot portion and the free end of the latch may have complementary compound surfaces, profiled such that movement of the leg portion into the slot causes the latch to flex away from the inner sidewall, until the foot portion resides beneath the latch. The foot portion may extend rearwardly further than the leg portion, whereby, when the leg portion is moved to a forward position outside of the spacing, the foot portion is still locked beneath the latch.

The electrical connector housing may also have at least two terminal receiving cavities and two slots, and the TPA may have two leg portions movable into the slots, with a bridge portion spanning the foot portions. The bridge portion may be profiled to lie adjacent to an outer wall of the housing, and slide along the surface thereof in the sliding movement of the TPA. The resilient latch may extend forwardly towards the mating face, and the bridge portion, when in the locked position, is spaced from the mating face. The bridge portion and outer wall may include cooperating latching members to latch the TPA in the locked position. The bridge portion and outer wall may include cooperating latching members to maintain the bridge in a position adjacent the housing outer wall.

DETAILED DESCRIPTION OF THE PREFERRED EMBODIMENT

Figure 1:
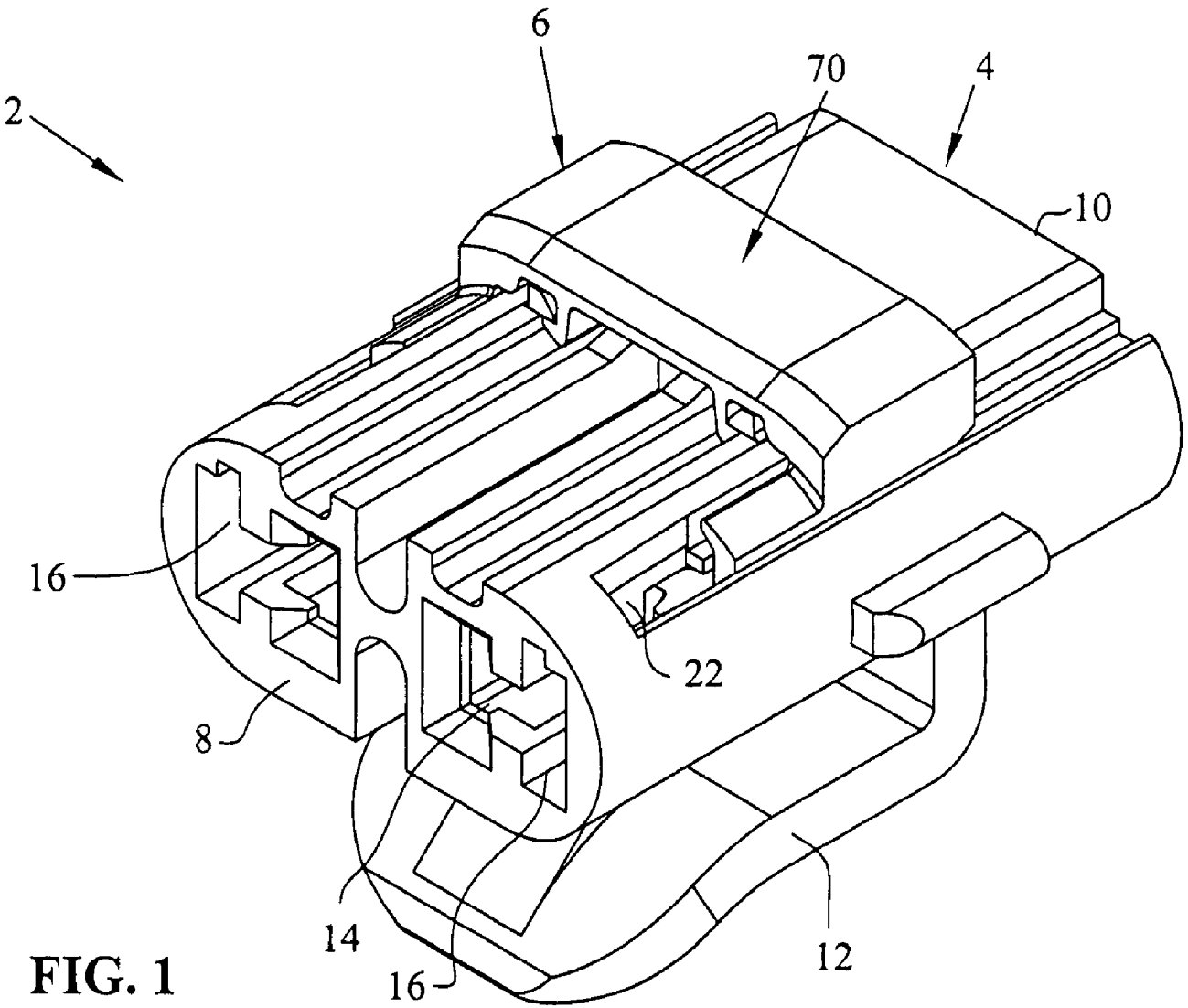
FIG. 1 is a front perspective view of the housing of the present invention, with the terminal positioning assurance member (TPA) in an assembled position, and shown in the locked position.

With respect first to FIG. 1, the electrical connector of the present invention is shown as reference numeral 2, which is generally comprised of an electrical connector housing 4 and a terminal positioning assurance member (TPA) 6. The connector housing 4 includes a front mating face 8 and a rear terminal receiving face 10. A latch arm 12 is provided for latching the connector 2 to a mating connector, as is well known in the art. It should be appreciated that the connector housing, and TPA are comprised of an insulative material, such as a plastic material, as is well known in the art.

The connector housing 4 further comprises terminal receiving cavities 14, which, as will be clearer herein, extending between the front mating face 8 and the rear terminal receiving face 10. Finally, as shown in FIG. 1, housing 4 includes a slot 16 associated with each cavity 14, into which the TPA 6 is inserted, and which allows the TPA to move longitudinally, in the direction of the cavities 14 between a terminal receiving position and a terminal locking position.

Figure 2:
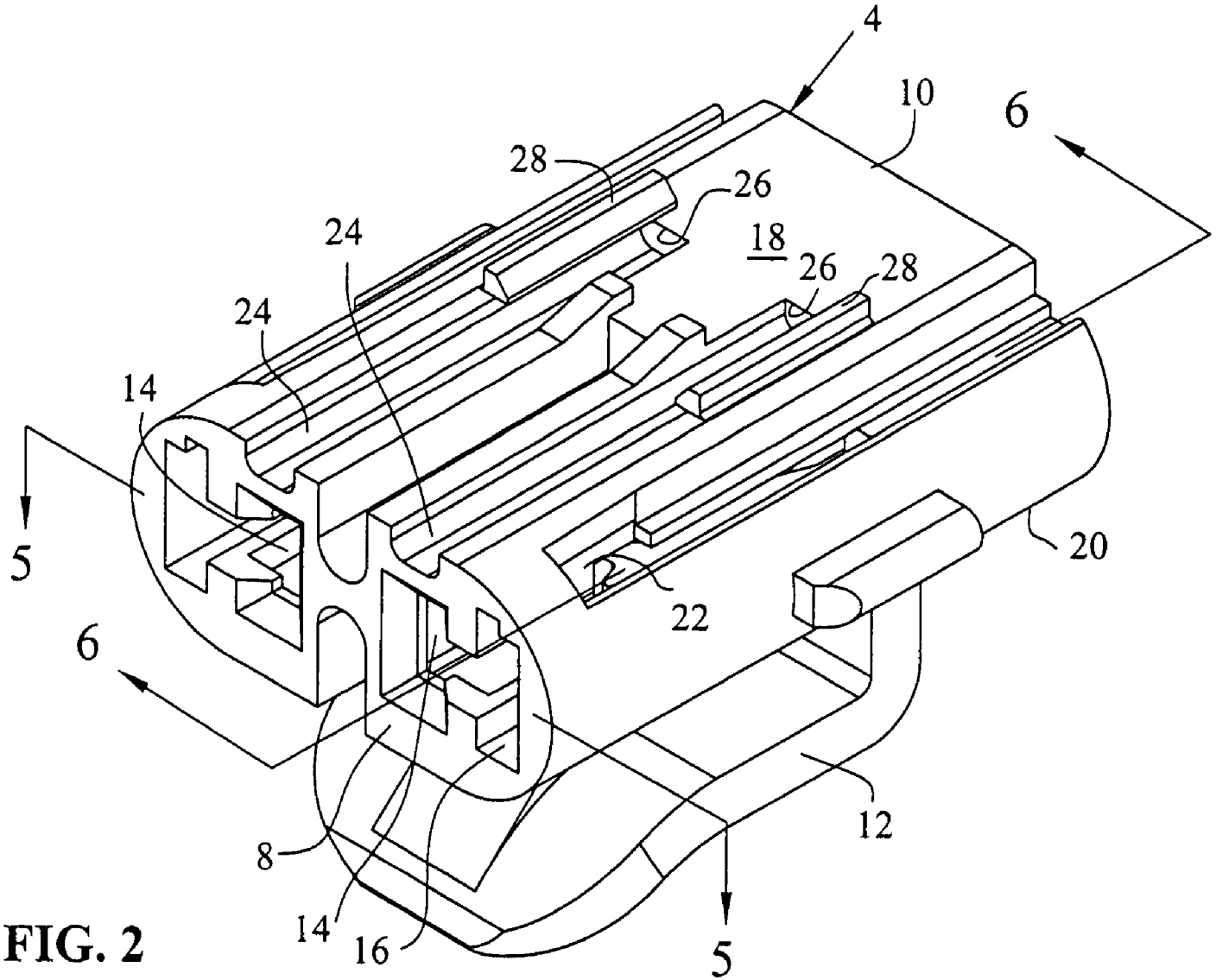
FIG. 2 is a front perspective view similar to that of FIG. 1, less the TPA.
Figure 3:
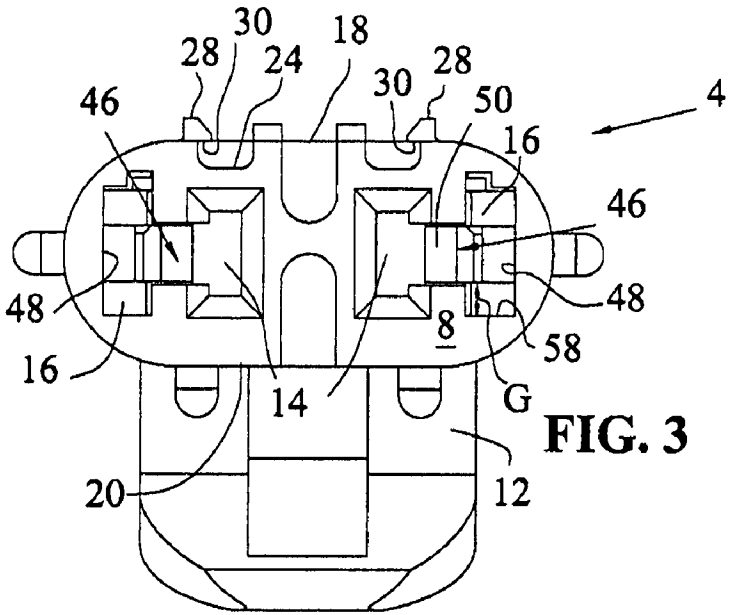
FIG. 3 is a front plan view of the connector housing of FIG. 2.
Figure 4:
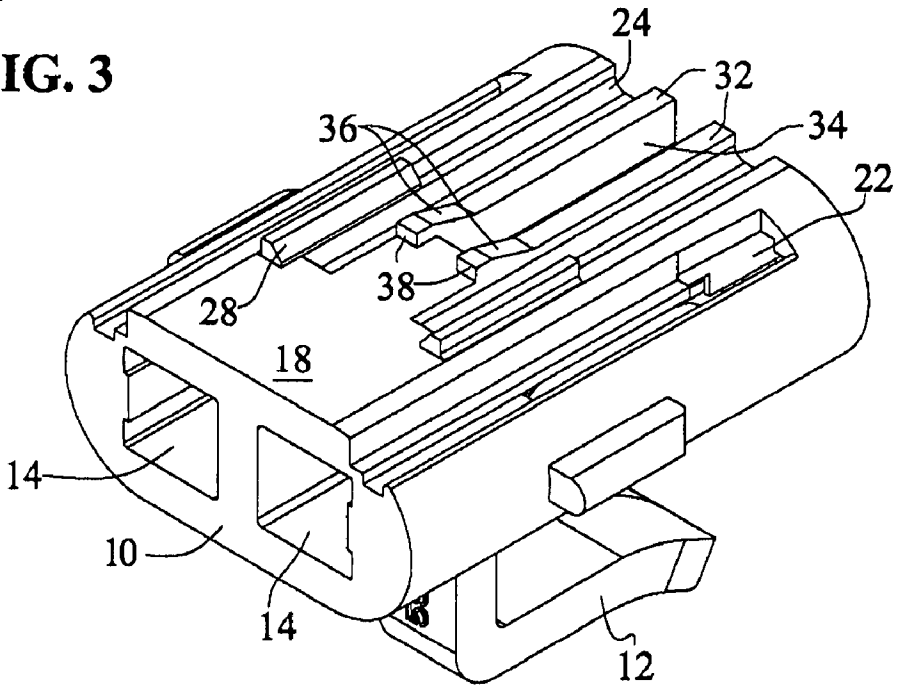
FIG. 4 is a rear perspective view of the housing shown in FIG. 2.

With respect now to FIGS. 2–4, the housing 4 will be described in greater detail. The housing has a top wall 18 and a lower wall 20, where latch arm 12 extends downwardly from lower wall 20. Top wall 18 includes access openings 22 which extend transversely through the housing top wall 18 to access slots 16, as will be further described herein. Top wall 18 further includes guide channels 24, which extend rearwardly to define end walls 26 (FIG. 2). Retaining walls 28 extend upwardly from top wall 18, and as best shown in FIG. 3, have an overlying wall portion 30, which overlies the guide channels 24, as further described herein. Top wall 18 further includes two ribs 32 (FIG. 4), which are formed by guide channels 24 and a central relief area 34. Ribs 32 extend rearwardly, as best shown in FIG. 4, and extend into ramped surfaces 36, which define latching surfaces 38.

Figure 5:
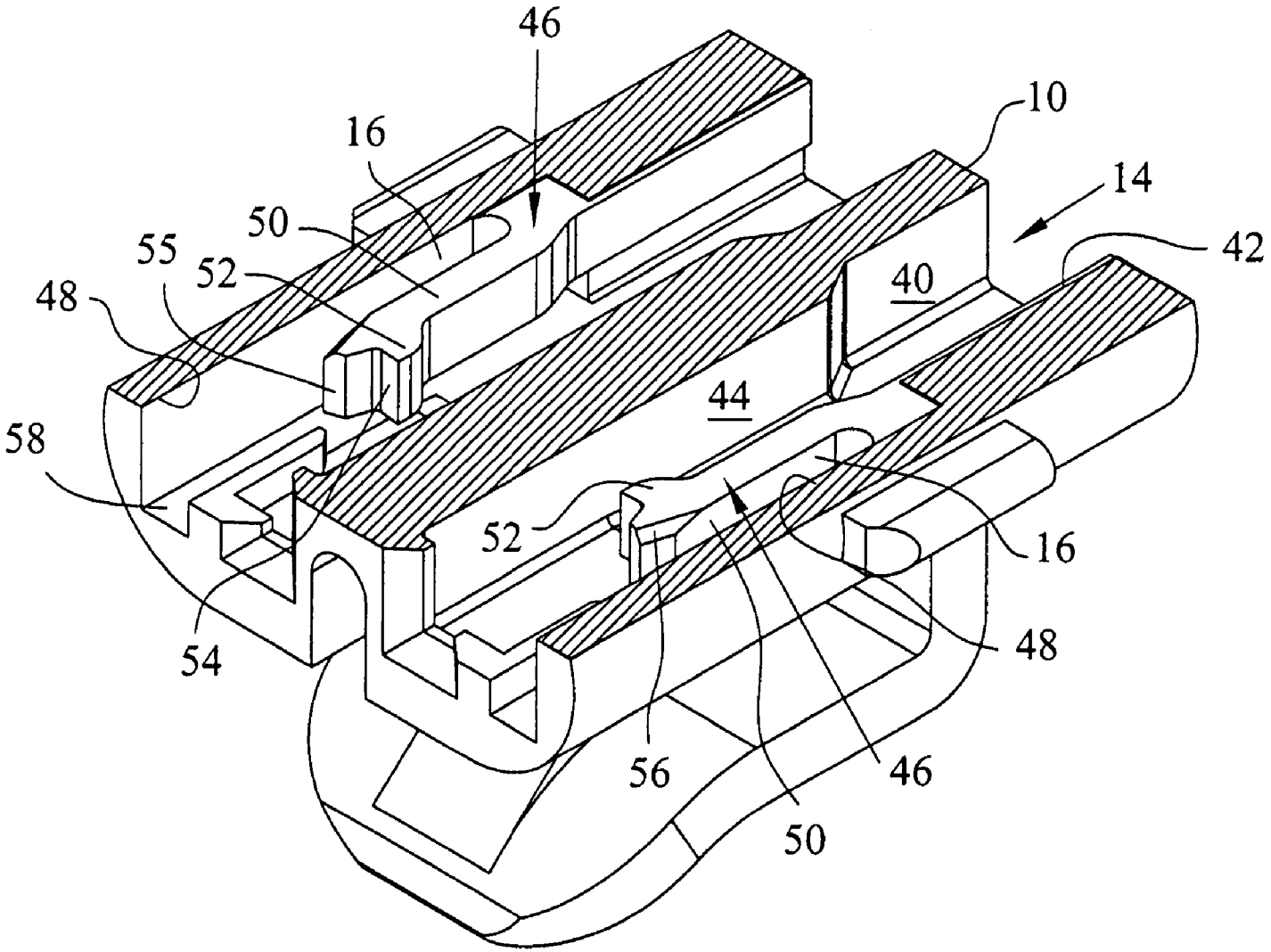
FIG. 5 is a cross-sectional view through lines 5—5 of FIG. 2.

With reference now to FIG. 5, terminal receiving cavities 14 are shown in greater detail, where cavities 14 adjacent to rear face 10 are comprised of inner surfaces 40, 42, where surface 40 necks down to form inner surface 44, and where inner surface 42 transitions inwardly to define primary latch 46. As best shown in FIG. 5, latch 46 is attached partly at surface 42 and partly from an internal sidewall 48 of cavity 14, to define a forwardly extending latch arm 50 in the form of a cantilever beam. Slot 16 extends longitudinally and defines a spacing between latch arm 50 and inner surface 48. Both latch 46 and internal sidewall 48 may also be seen in FIG. 3, that is, straight through and into slot 16. It should be appreciated that the terminal receiving cavities are profiled to receive any number of electrical contacts, such as those manufactured from a highly conductive material such as Beryllium Copper, or the like.

With reference still to FIG. 5, latch arm 50 extends forwardly and generally parallel with terminal receiving cavity 14. Latch 46 includes a latching lug 52 having a forwardly facing shoulder 54 to lock with a terminal to be inserted into the cavity 14, and a forwardly facing shoulder 55 to ensure full insertion of the terminals, as described herein. As also shown in FIG. 5, a compound angled surface is provided at 56, at the forward end of latch arm 50, and together with chamfered surface 60 (FIG. 6), will assist in the insertion of the TPA 6, as will be described herein. Finally and with respect to FIGS. 3 and 6, a gap G is defined between the bottom of latch arm 50 and a floor 58 of slot 16, as will also be described further herein.

Figure 6:
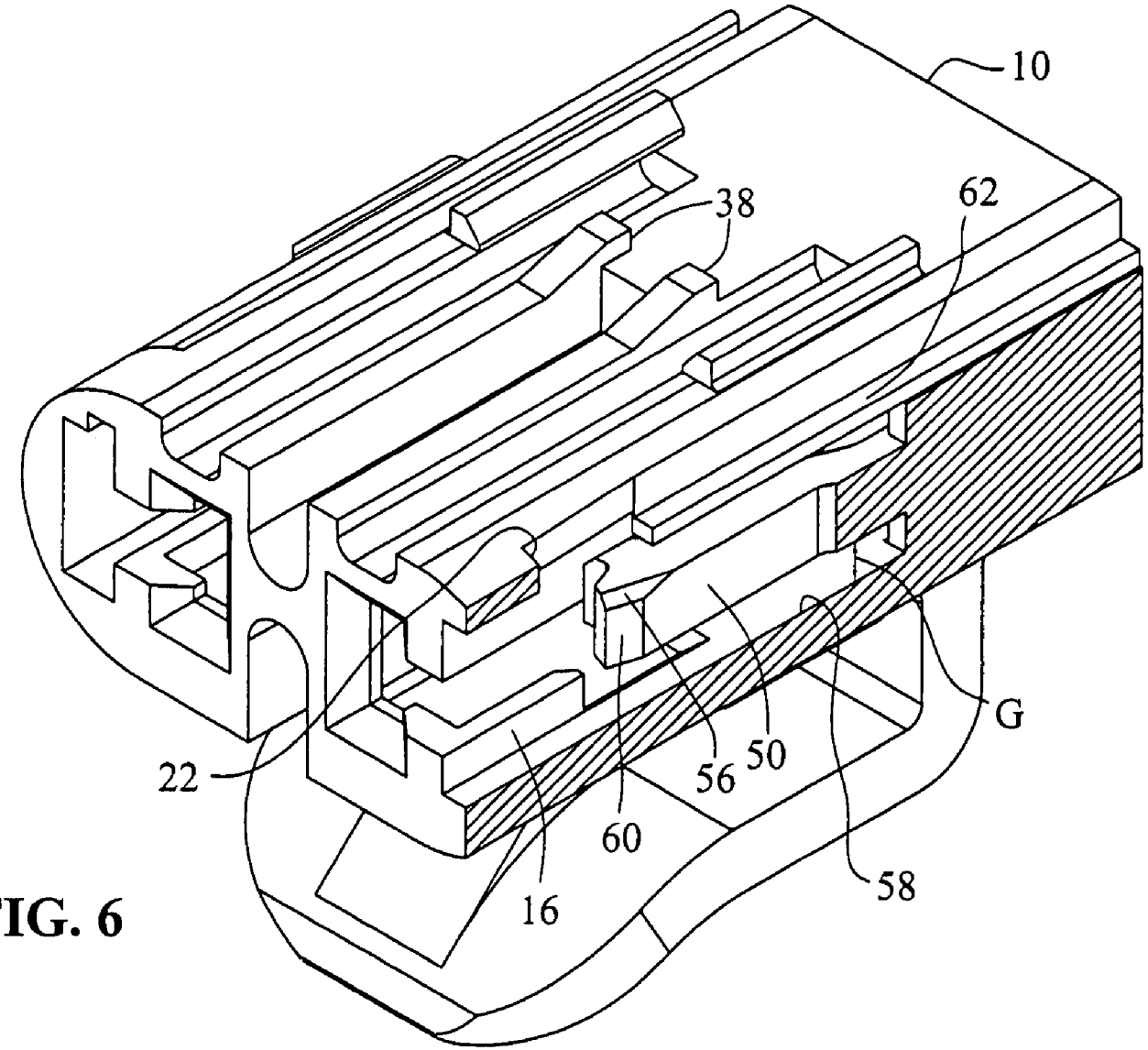
FIG. 6 is a cross-sectional view through lines 6—6 of FIG. 2.

Reference will now be made to FIG. 6, which is a longitudinal cross section through slot 16, and therefore latch arm 50 is shown extending in a parallel manner with the slot, and with latch arm 50 partly extending into the slot 16. Access opening 22 is also shown in greater detail such that opening 22 shows a transverse communication into the slot 16. Gap G is also shown more clearly between latch arm 50 and floor 58 of slot 16. Ledge 62 is also defined above latch arm 50, and extends rearwardly to rear face 10.

Figure 7:
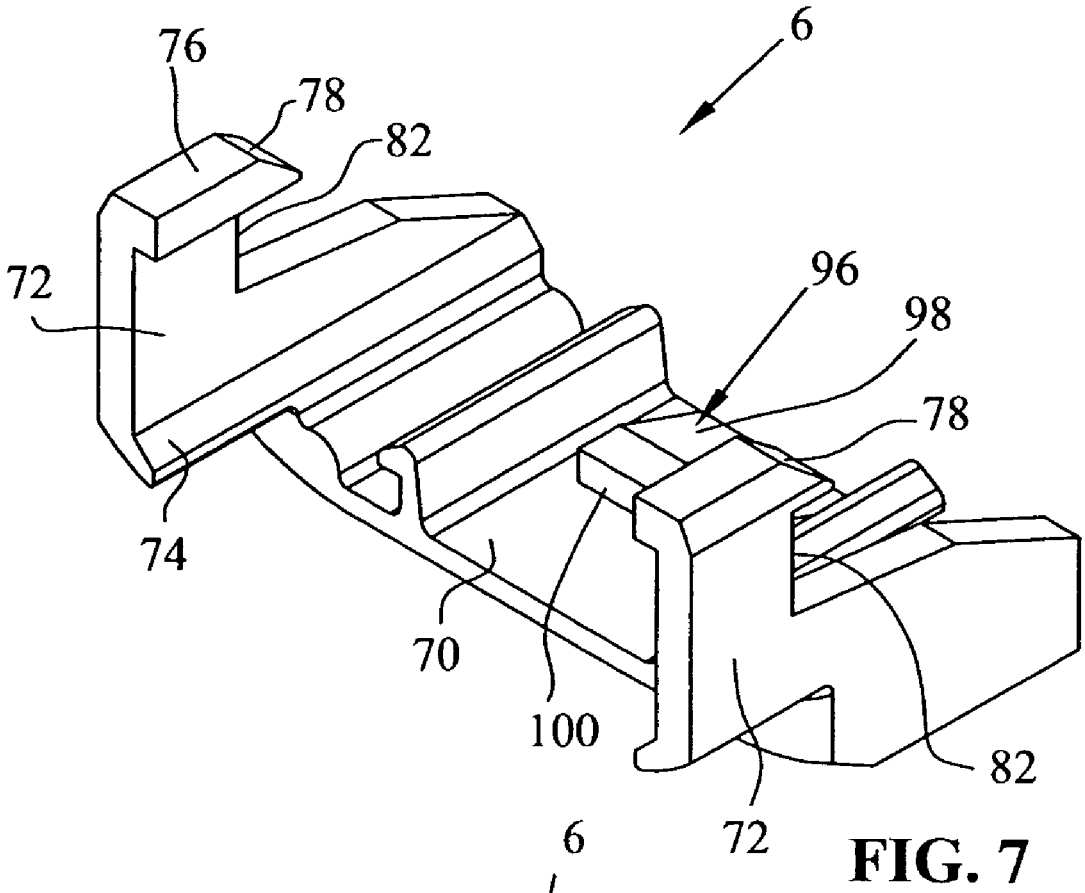
FIG. 7 is a perspective view of the TPA member.
Figure 8:
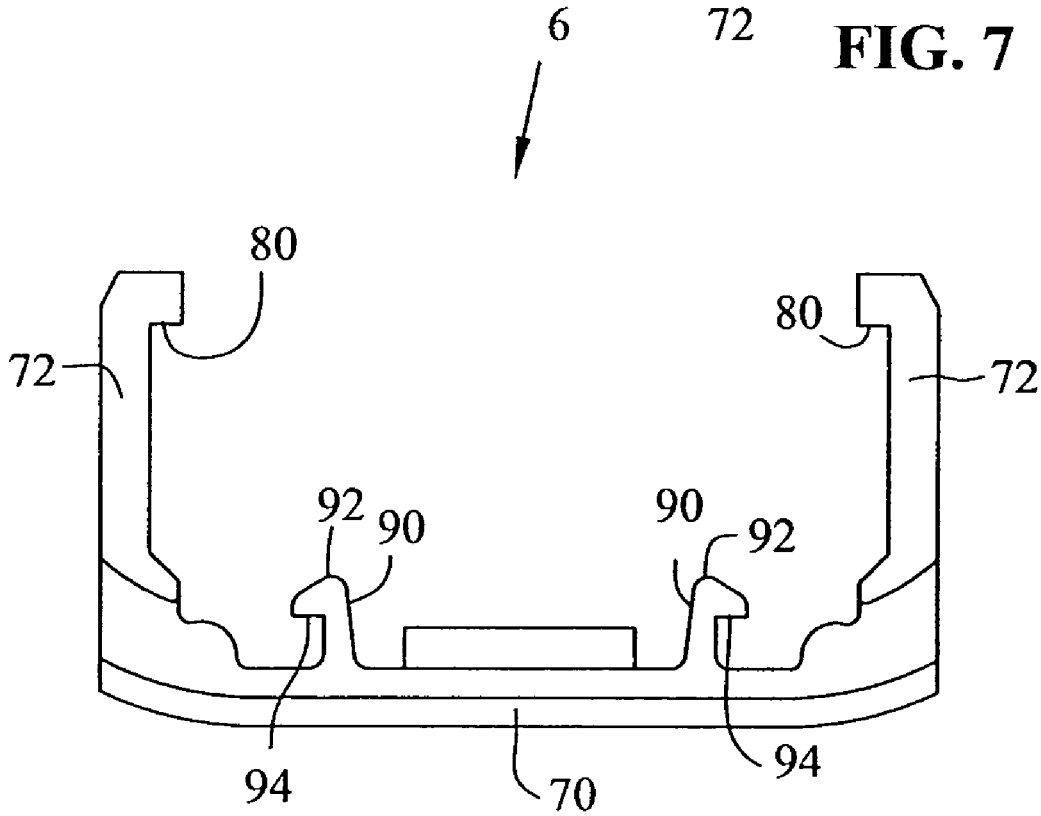
FIG. 8 shows a front plan view of the TPA of FIG. 7.

With reference now to FIGS. 7 and 8, the TPA 6 will be described in greater detail. As shown in FIG. 7, the TPA is shown with a main wall or bridge portion 70 with leg portions 72 upstanding therefrom. As shown best with reference to FIG. 7, leg portions 72 extend juxtaposed relative to bridge portion 70 and define an overlapping wall portion 74 and a retaining foot portion 76. Retaining foot portion 76 is comprised of a ramped surface 78 and an overlapping wall section 80, as best shown in FIG. 8. It should also be appreciated from FIG. 7 that the foot portion 76 extends forwardly from leg portion 72 to define a notched opening at 82, as will also be described further herein.

With respect now to FIG. 8, bridge portion 70 further includes gripping members 90 extending upwardly therefrom having a generally rounded portion at 92 and a locking surface at 94. Finally, and as best shown in FIG. 7, bridge portion 70 also includes a latch member 96 comprised of a ramped surface 98 and a locking surface 100. With the components of the connector assembly as defined above, the assembly and operation of the connector will be described below. Furthermore, while TPA 6 and housing 4 are shown as separate members, it would be possible to integrally mold the two parts together for ease of manufacture and assembly. For example, the TPA could be molded in a position where feet 76 are adjacent to access openings 22.

Figure 10:
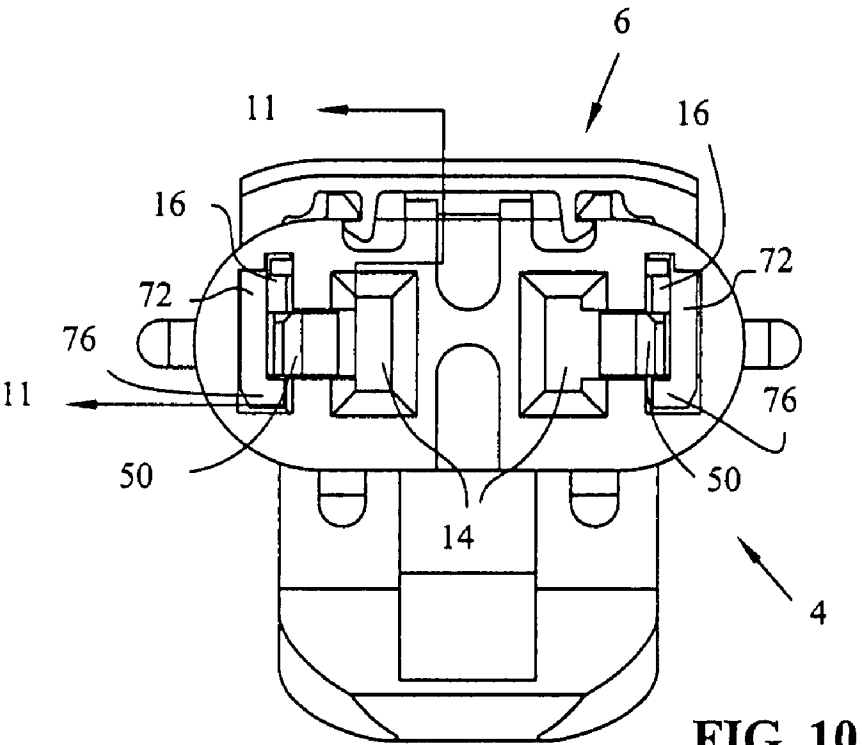
FIG. 10 shows the terminal positioning assurance member in its fully inserted position.
Figure 9:
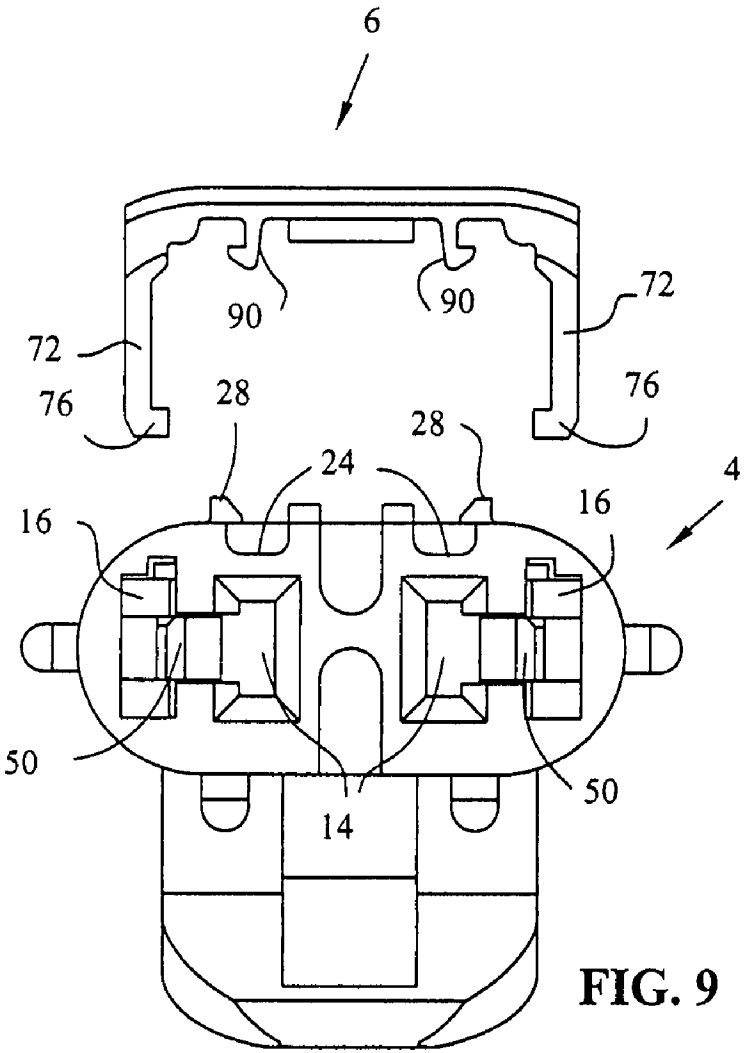
FIG. 9 shows a front plan view of the connector housing with the TPA poised for receipt therein.

As shown in FIG. 9, TPA 6 is shown poised for receipt above connector housing 4. It should be appreciated that leg portions 72 are profiled for receipt within access opening 22 (FIGS. 2, 6) into the position shown in FIG. 10. The foot portions 76 of TPA 6 assist in both the insertion and retention of the TPA. As mentioned above, the foot portions 76 have ramped or chamfered surfaces 78, which cooperate with the surfaces 56, 60 (FIG. 6) of the latch arm for insertion of the legs into the position shown in FIG. 10. During the insertion of the leg portions 72, ramped surface 78 cooperates first with compound surface 56, (FIG. 6). Further insertion of the leg portions 72 into the slots 16 causes movement of the latch arm 50 towards cavity 14 until such time as the foot portions 76 reside within the gap G, as shown in FIG. 10, and are snapped in place under the latch arm 50 to a preliminarily locked position.

Figure 11:
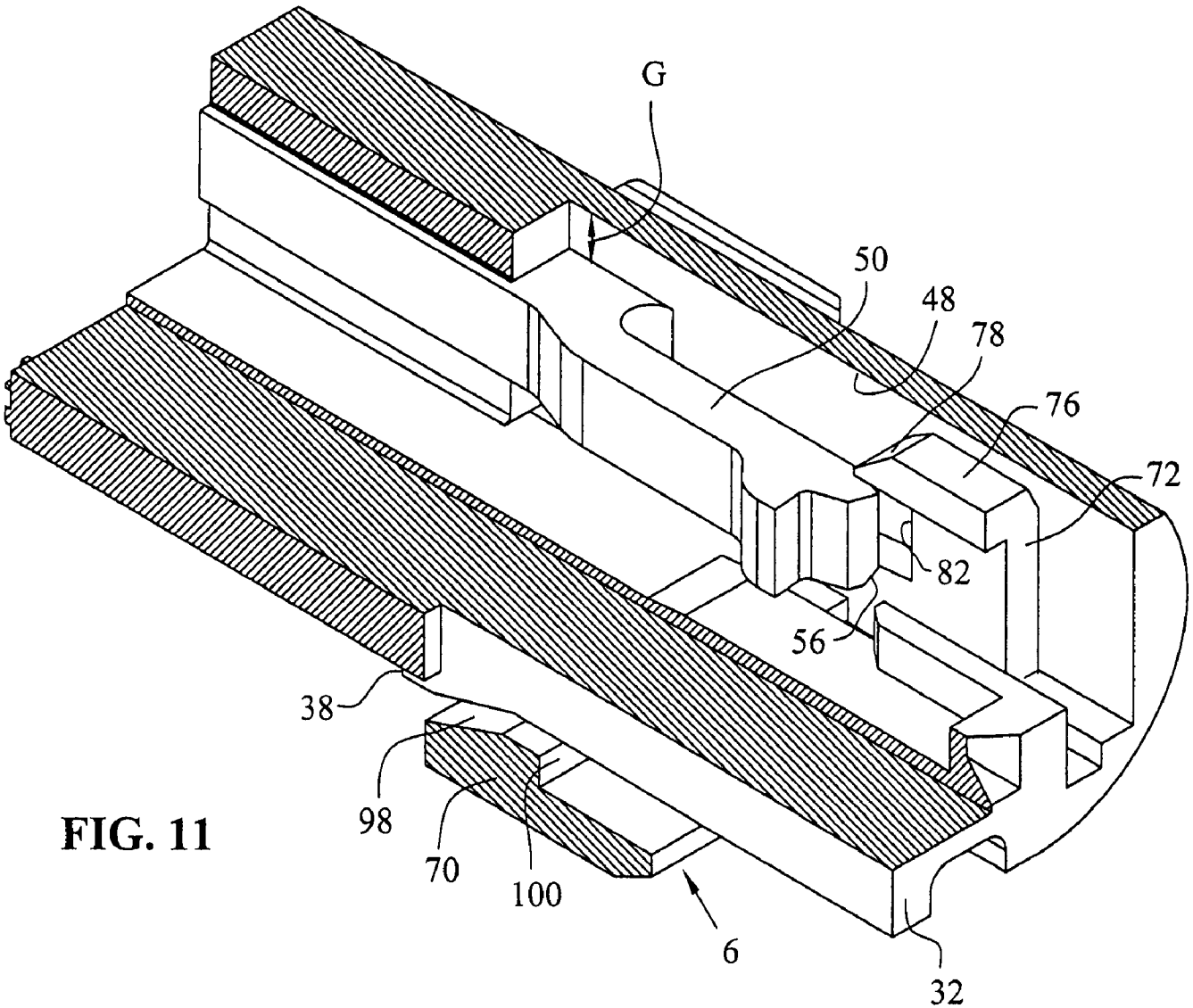
FIG. 11 shows a cross-sectional view through the staggered lines shown in FIG. 10, where the connector assembly is in a position to receive an electrical contact.

When the TPA 6 is first inserted, the TPA is in the position shown in FIG. 11. Note that FIG. 11 is the cross-sectional view through lines 11—11 of FIG. 10, but is rotated longitudinally such that the foot portions 76 are shown on the top of latch arm 50. FIG. 11, however, demonstrates how the foot portions 76 of the TPA 6 retains the TPA 6 by overlapping the latch arm at the rearward end of the foot portion, while residing in the gap G. That is, the portion adjacent to ramped surface 78 overlies the latch, preventing removal of the TPA therefrom. At the same time, when in the position shown in FIG. 11, latch arm 50 can bias towards inner surface 48 and relative to the foot portion 76 into the notched opening 82. It should also be appreciated that, when the TPA is shown in the position of FIG. 11, the gripping members 90 (FIG. 9) are residing within their respective guide channels 24, but are not yet positioned beneath their respective retaining wall 28.

Figure 12:
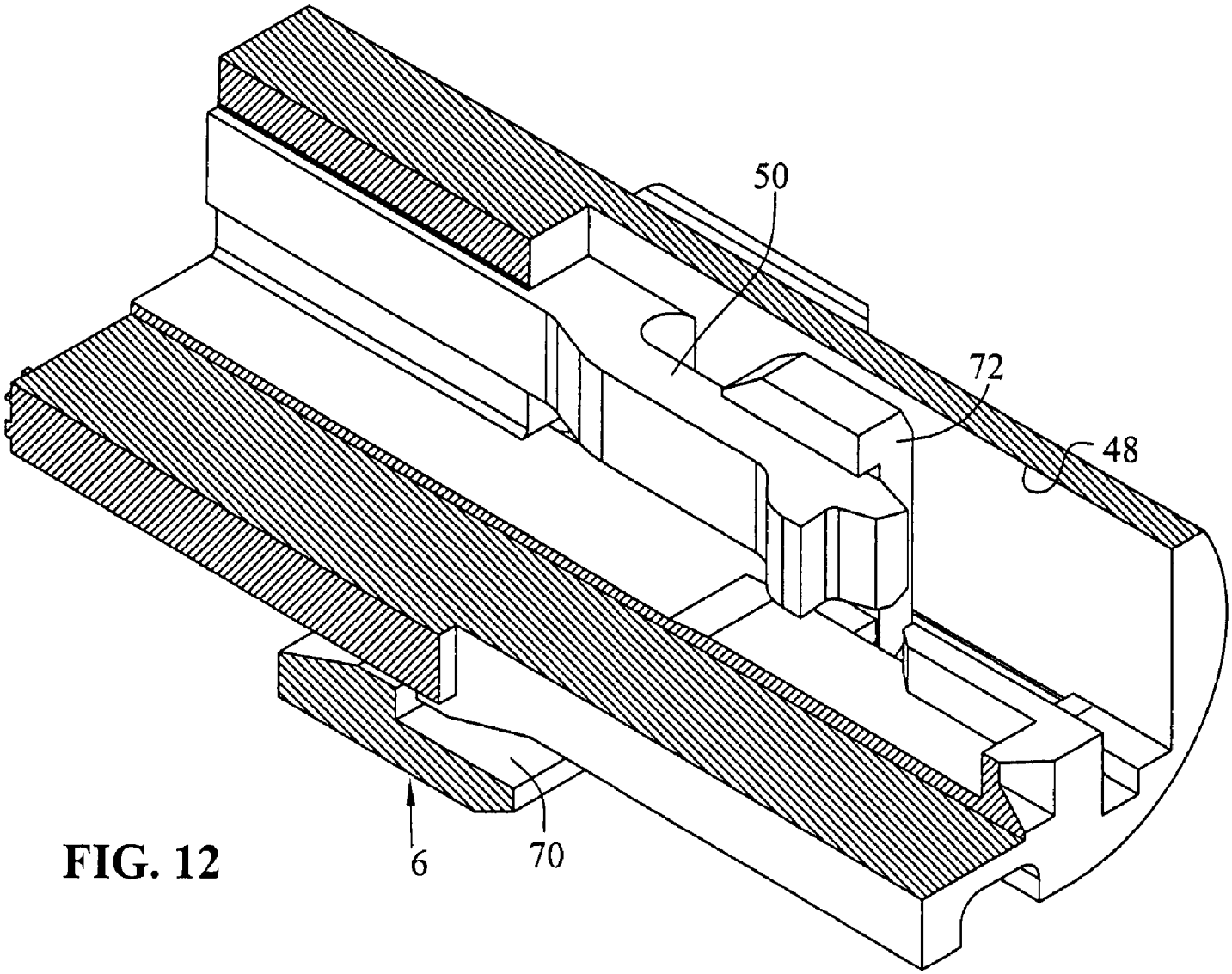
FIG. 12 is a view similar to that of FIG. 11 showing the TPA in the fully locked position.

As the TPA 6 is moved rearwardly from the position shown in FIG. 11, the gripping members 90 continue to reside in their guide channels 24 and first become engaged beneath the overlying wall portions 30 (FIG. 3) of the retaining walls 28. Ramped surface 98 (FIG. 7, FIG. 11) of latch member 96 then begins to cooperate with ramped surface 36 (FIG. 4) until the cooperating locking surfaces 100, 38 (FIG. 11) become locked into the position shown in FIG. 12. As shown in FIG. 12, leg portions 72 are positioned in the slot 16 between inner surface 48 and latch arm 50, preventing the latch from moving towards inner surface 48 to release a terminal locked therein. It should also be appreciated that the TPA is locked in the longitudinal position and gripping members 90 (FIG. 8) are locked against their corresponding overlying wall portions 30 (FIG. 3) to prevent the outward movement of bridge portion 70 of the TPA. This prevents outward flexure of the bridge portion 70 and accidental release of the corresponding locking surfaces 100, 38 (FIG. 11).

Advantageously, TPA 6 prevents the accidental removal of the terminals by "backing up" the primary latch 46 of the connector housing 4 to prevent the accidental removal of a terminal inserted in the connector housing. At the same time, the TPA 6 prevents the mating connection of an electrical connector if the terminals are not properly loaded. As shown in FIG. 1, the TPA is shown in the locked position, with the bridge portion 70 of the TPA 6 in a rearward position. Had the terminals not been properly locked, the latches 46 would still reside within slot 16, and shoulder 55 would prevent the leg portions 72 of the TPA 6 from moving into the slot and therefore the bridge portion 70 of the TPA would still be in the position of FIG. 11. The bridge portion 70, if in the position shown in FIG. 11, would prevent a mating connector from overlapping the connector housing 4 and moving to a fully mated position.

The invention claimed is:

1. An electrical connector, comprising:

a housing having at least one terminal receiving cavity extending between a mating face and a terminal receiving face, a resilient latch extending from an internal sidewall of said at least one terminal receiving cavity, said latch being spaced from said internal sidewall to form a spacing for the resilient movement of said latch towards said internal sidewall;

a slot extending through said housing and in a generally parallel manner with said cavity, and said slot being generally aligned with said spacing;

an access opening extending transversely through said housing and into communication with said slot;

a terminal positioning assurance member (TPA), comprised of at least a leg portion which is movable through said access opening and into said slot, said TPA being slidable between a position allowing flexure of said latch and a position into said spacing, preventing substantial flexing of said latch, and wherein the TPA further comprises a foot portion extending from said leg portion, said foot portion being profiled to extend under, and lock said TPA to said latch.

2. The electrical connector of claim 1, wherein said foot portion and a free end of said latch have complementary compound surfaces, profiled such that movement of said leg portion into said slot causes the latch to flex away from said internal sidewall, until said foot portion resides beneath said latch.

3. The electrical connector of claim 1, wherein said foot portion extends rearwardly further than said leg portion, whereby, when said leg portion is moved to a forward position outside of said slot, said foot portion is still locked beneath said latch.

4. The electrical connector of claim 1, wherein said housing has at least two terminal receiving cavities, and two slots, and said TPA has two leg portions movable into said slots, with a bridge portion spanning said foot portions.

5. An electrical connector, comprising:

a housing having at least two terminal receiving cavities extending between a mating face and a terminal receiving face, a resilient latch extending from an internal sidewall of said terminal receiving cavities, said latch being spaced from said internal sidewall to form a spacing for the resilient movement of said latch towards said internal sidewall;

a slot extending through said housing and in a generally parallel manner with each said cavity, and said slot being generally aligned with said spacing;

an access opening extending transversely through said housing and into communication with said slot;

a terminal positioning assurance member (TPA), comprised of at least two leg portions movable through said access opening and into said slots, with a bridge portion spanning said foot portions, said TPA being slidable between a position allowing flexure of said latch and a position into said spacing, preventing substantial flexing of said latch, wherein said bridge portion is profiled to lie adjacent to a top wall of said housing, and slide along the surface thereof in the sliding movement of said TPA.

6. The electrical connector of claim 5, wherein said bridge portion and top wall include cooperating latching members to latch said TPA in said locked position.

7. The electrical connector of claim 5, wherein said bridge portion and top wall include cooperating latching members to maintain said bridge in a position adjacent said housing top wall.

8. An electrical connector, comprising:

a housing having at least one terminal receiving cavity extending between a mating face and a terminal receiving face; a resilient latch extending from an internal sidewall of said at least one terminal receiving cavity, said latch being spaced from said internal sidewall to form a spacing for the resilient movement of said latch towards said internal sidewall;

a slot extending through said housing and into said cavity, said slot being generally aligned with said spacing;

a terminal positioning assurance member (TPA), comprised of at least a leg portion which is movable into said slot and into said spacing, said TPA further comprising a foot portion extending from said leg portion, said foot portion being profiled to extend under, and lock said TPA to said resilient member, the TPA leg portion being movable in an insertion direction into the slot, and the foot portion preventing movement of the TPA in a direction opposite the insertion direction.

9. The electrical connector of claim 8, wherein said TPA is slidable between positions in said spacing preventing substantial flexing of said latch, and forward of said spacing, to a position allowing flexure of said latch, said foot member being slidable along the length of said latch.

10. The electrical connector of claim 8, wherein said foot portion and said free end of said latch have complementary compound surfaces, profiled such that movement of said leg portion into said slot causes the latch to flex away from said internal sidewall, until said foot portion resides beneath said latch.

11. The electrical connector of claim 8, wherein said foot portion extends rearwardly further than said leg portion, whereby, when said leg portion is moved to a forward position outside of said slot, said foot portion is still locked beneath said latch.

12. The electrical connector of claim 8, wherein said housing has at least two terminal receiving cavities, and two slots, and said TPA has two leg portions movable into said slots, with a bridge portion spanning said foot portions.

13. The electrical connector housing of claim 12, wherein said bridge portion is profiled to lie adjacent to a top wall of said housing, and slide along the surface thereof in the sliding movement of said TPA.

14. The electrical connector of claim 12, wherein said bridge portion and top wall include cooperating latching members to latch said TPA in said locked position.

15. The electrical connector of claim 12, wherein said bridge portion and top wall include cooperating latching members to maintain said bridge in a position adjacent said housing top wall.

16. An electrical connector, comprising:

a housing having at least one terminal receiving cavity extending between a mating face and a terminal receiving face, a resilient latch extending from an internal sidewall of said at least one terminal receiving cavity, said latch being spaced from said internal sidewall to form a spacing for the resilient movement of said latch towards said internal sidewall;

a terminal positioning assurance member (TPA), comprised of a first portion which prevents the latch from biasing inwardly, and a second portion which retains the TPA to the resilient latch.

17. The electrical connector of claim 16, wherein said TPA first portion is comprised of a leg portion, which is slidably movable within said spacing.

18. The electrical connector of claim 17, wherein, said TPA second portion is comprised of a foot portion extending from said leg portion, said foot portion being profiled to extend under, and lock said TPA to said resilient member.

19. The electrical connector of claim 18, further comprising a slot extending through said housing and into said cavity, said slot being generally aligned with said spacing, said leg portion being movable into said slot and into said locked position with said latch.

20. The electrical connector of claim 19, wherein said slot extends into said housing transversely of said spacing, and said leg portion being slidably movable along said slot while retained to said latch.

21. The electrical connector of claim 20, wherein said foot portion and said free end of said latch have complementary compound surfaces, profiled such that movement of said leg portion into said slot causes the latch to flex away from said internal sidewall, until said foot portion resides beneath said latch.

22. The electrical connector of claim 20, wherein said foot portion extends rearwardly further than said leg portion, whereby, when said leg portion is moved to a forward position outside of said spacing, said foot portion is still locked beneath said latch.

23. The electrical connector of claim 20, wherein said housing has at least two terminal receiving cavities, and two slots, and said TPA has two leg portions movable into said slots, with a bridge portion spanning said foot portions.

24. The electrical connector housing of claim 23, wherein said bridge portion is profiled to lie adjacent to a top wall of said housing, and slide along the surface thereof in the sliding movement of said TPA.

25. The electrical connector of claim 24, wherein said bridge portion and top wall include cooperating latching members to latch said TPA in said locked position.

26. The electrical connector housing of claim 24, wherein said resilient latch extends forwardly towards said mating face, and said bridge portion, when in said locked position, is spaced from said mating face.

27. The electrical connector of claim 25, wherein said bridge portion and top wall include cooperating latching members to maintain said bridge in a position adjacent said housing top wall.

* * * * *